US006637516B1

(12) United States Patent
Boyd

(10) Patent No.: US 6,637,516 B1
(45) Date of Patent: Oct. 28, 2003

(54) HIGH TORQUE AND HIGH CAPACITY ROTATABLE CENTER CORE AND FLOATABLE SEALED BODY ASSEMBLIES WITH UNIVERSAL RAM APPLICATIONS AND METHOD

(76) Inventor: Anthony R. Boyd, 2204 Turnberry Dr., Loreauville, LA (US) 70552

( * ) Notice: Subject to any disclaimer, the term of this patent is extended or adjusted under 35 U.S.C. 154(b) by 0 days.

(21) Appl. No.: 09/994,161

(22) Filed: Nov. 26, 2001

(51) Int. Cl.[7] ..... E21B 33/06

(52) U.S. Cl. ..... 166/379; 166/84.1; 166/85.4; 166/386; 175/57; 175/218; 251/1.3

(58) Field of Search ..... 166/85.4, 86.3, 166/84.3, 84.1, 386, 379; 175/57, 317, 218; 251/1.3

(56) References Cited

U.S. PATENT DOCUMENTS 1,723,934 A * 8/1929 Heggem ..... 166/84.1
1,854,058 A * 4/1932 Otis ..... 277/325
3,145,995 A * 8/1964 Adamson et al. ..... 166/53
3,163,430 A * 12/1964 Normand ..... 166/84.1
4,860,826 A * 8/1989 Land ..... 166/86.3
5,645,098 A * 7/1997 Morrill ..... 137/15.18
6,113,061 A * 9/2000 Van Winkle ..... 251/1.3
6,223,819 B1 * 5/2001 Heinonen ..... 166/85.4
6,244,336 B1 * 6/2001 Kachich ..... 166/55

* cited by examiner

*Primary Examiner*—Hoang Dang
(74) *Attorney, Agent, or Firm*—Domingue & Waddell, PLC

(57) ABSTRACT

A high torque and high capacity rotatable center core and floatable sealed body assembly with universal ram applications and method for use in a drill string, including a central core assembly, connected between a swivel on its upper end and the drill string below, having a central passageway therethrough; a first outer assembly, having a central bore for slidably engagement around a portion of the central core assembly; a second outer assembly, having a central bore for slidably engaging around a portion of the central core assembly above the first outer assembly; a pair of opposing transverse bores in both the first and second outer assemblies, corresponding to transverse bores in the central core assembly; sleeve members for aligning the bores of the core assembly and the first and second outer assemblies; and rams positionable in the transverse bores in the first and second outer assemblies for sealing off the passageway in the central core assembly when moved to the sealing position.

16 Claims, 7 Drawing Sheets

HIGH TORQUE AND HIGH CAPACITY ROTATABLE CENTER CORE AND FLOATABLE SEALED BODY ASSEMBLIES WITH UNIVERSAL RAM APPLICATIONS AND METHOD

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The system of the present invention relates to high torque and high capacity rotatable center core and floatable seal body assemblies with universal ram applications and the method of undertaking same. More particularly, the present invention relates to a seal assembly that would allow one to pick up the entire weight of the drill string, tubing or pipe which would allow one to rotate from the top and have the torque completely through it while rotating.

2. General Background of the Invention

In undertaking wireline work utilizing a side entry device, in the present state of the art, the device includes a packoff assembly at the entry to the side entry port which provides for protection against blowouts while the device is in use. However, while wireline is being lowered through the device, there must be an additional method to seal off the passageway while the wireline is in place. Therefore, there are provided blowout preventors positioned above the wireline packoff on the side entry device which may be manually or hydraulically closed to seal off the wireline in case of a blowout. Such blowout preventors are manufactured by, for example, Bowen, and are quite commonly used.

However, it would be beneficial to have such a blowout preventor located in the drill string itself, above the rig floor, which would allow the wireline to be sealed off below the swivel above the rig floor. In that manner, when the drill string below the swivel need to be rotated to provide torque, the blowout preventor would simply rotate with the string. However, in the case of a blowout, or in the event work needed to be done above the swivel in the side entry device, while the well is under pressure, the blowout preventors could be closed off. The type of blowout preventor currently used, as discussed above, manufactured by Bowen, would not have the capability of being placed within the drill string, since the device could not withstand the enormous weight of the drill string below the preventor. So, there is a need for a type of blowout preventor that can be positioned below the swivel, within the drill string, that can be maintained open, and allowed to rotate freely with the string, but in the event of work needed to be done above the device, the blowout preventors would be closed, and the well, although under pressure would not be capable of blowing out during the curative work.

BRIEF SUMMARY OF THE INVENTION

The system of the present invention solves the problem in the art in a simple manner. What would be provided is at least one blowout preventor, positioned within the drill string, above the rig floor, between a swivel and a length of drill pipe below, the apparatus including a principal body portion having a central bore for accommodating a central assembly, having a first under end attached to the lower end of the swivel, and a lower end attached to the drill pipe below; the central assembly would include a central bore for accommodating the passage of fluid or wireline through down hole; there is further provided a pair of transverse bores which would be aligned with the pair of transverse bores in the principal body portion so as to provide a piston within the bores, capable of moving into the central bore of the central assembly to seal the central bore from flow therethrough; there is further provided a sleeve slidably engaged within the transverse bores for aligning the bores of the body and the central assembly; the central assembly would provide an annular shoulder around its lower portion so that the principal body would rest upon when the transverse bores are aligned; there would be provided an upper ring in the wall of the central assembly to maintain the principal body in place between the shoulder and the upper ring; further, there are provided sealing rings to prevent fluid in the pistons of the blowout preventor from seeping into other parts of the assembly. There may be provided a plurality of the blowout preventors stacked one upon the other, which would allow multiple sealing off of the wireline, or other small pipe as wash pipe or coiled tubing but would not be interconnected so as to avoid potential stretching when the central assembly must take the weight of the drill string down hole.

The apparatus and method involved would allow one to pull on a center core and have the block with the rams without exerting any pull on the outside body of the block, which would allow one to rotate the drill string without having the torque on the ram body exerted. By using singles in the system, if the center core would have stretch and torque, the ram body would not be stretched or torqued in the present method.

This system would not only be used for drill pipe but may include the fact that when running wireline, the line may ball up under the pack off or grease head flow tubes. If pressure is exerted on the well, in order to correct the problem, one will close the rams in order to seal off the pressure and bleed off above the rams to correct the wireline problem. If one has a pump down tool below the rams, this would allow one to pump fluids downhole if one would need to kill the well.

Therefore it is a principal object of the present invention to provide a blowout preventor system above the rig floor within the drill string to allow sealing off downhole in order to do work on a side entry or top entry device above the swivel.

It is a further object of the present invention to provide a blowout preventor system in the drill string above the rig floor which can withstand the weight of the drill string without damage to the blowout preventor.

It is a further object of the present invention to provide a blowout preventor system in the drill string above the rig floor which would allow for a plurality of disconnected blowout preventors aligned in sequence to take the weight of the drill string but avoid the preventors from being damaged.

It is a further object of the present invention to include a method and apparatus, which would provide a seal assembly in the drill string that would allow one to pick up the entire weight of the drill string tubing or pipe by being able to rotate from the top and have the torque completely go through it in order to rotate the pipe below it.

It is a further object of the present invention to provide a system which would allow tools or pipe to enter down the center bore of the apparatus, and would allow it to be closed to control well pressure below it so that any tools or pipe above it which would need to be worked or changed could do so while controlling well pressure below it.

It is a further object of the present invention to provide a system for use on chemical cutting or regular logging applications where you can use under high pressure tubing connections or high pressure connections which would include a grease head on top to control well pressure. This would allow one to eliminate the Bowen quick connects which are normally used without elevators and would not have pull on the tubing below.

It is a further object of the present invention to provide a system which is applicable when doing many types of applications, so that one is able to pull while chemical cutting the pipe below with heavy loads and still have the availability to rotate the pipe. The blow out preventors of the present state of the art cannot rotate or withstand heavy loads, as is the present invention.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
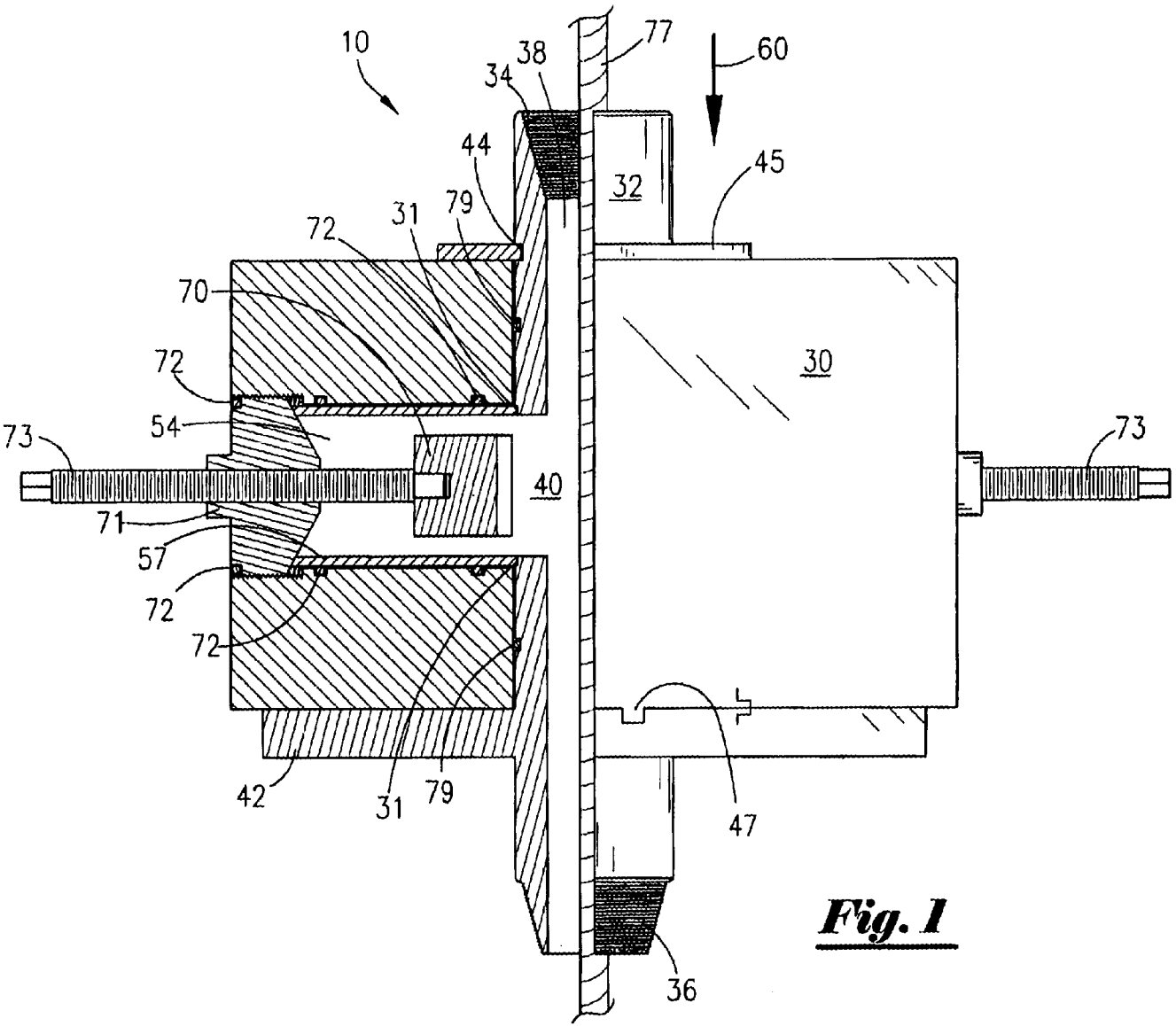
FIG. 1 is a cross-section view of the principal embodiment of the single core assembly of the present invention.
Figure 2:
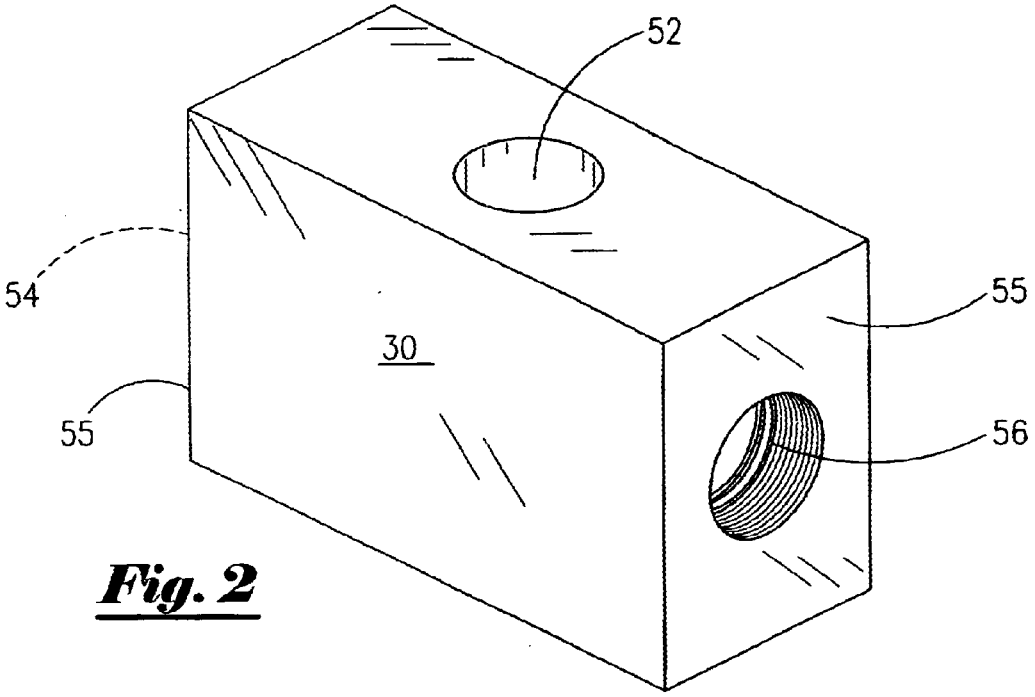
FIG. 2 is a side view of a single block for accommodating a single core assembly for high pressure use in the present invention.
Figure 3:
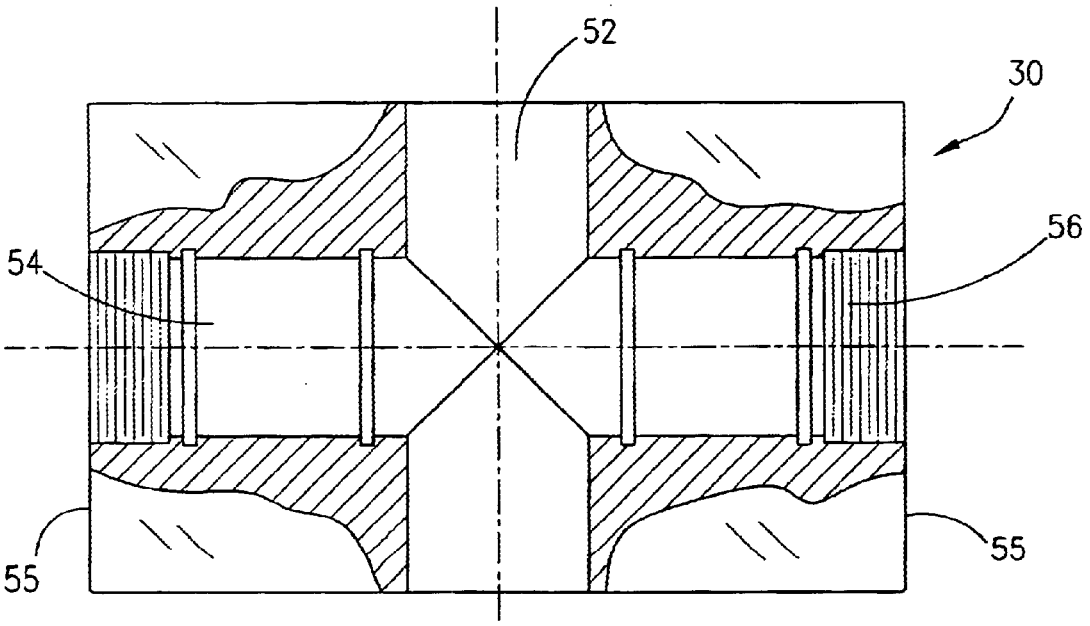
FIG. 3 is a cross-section view of a single core assembly utilized in the system of the present invention.
Figure 4:
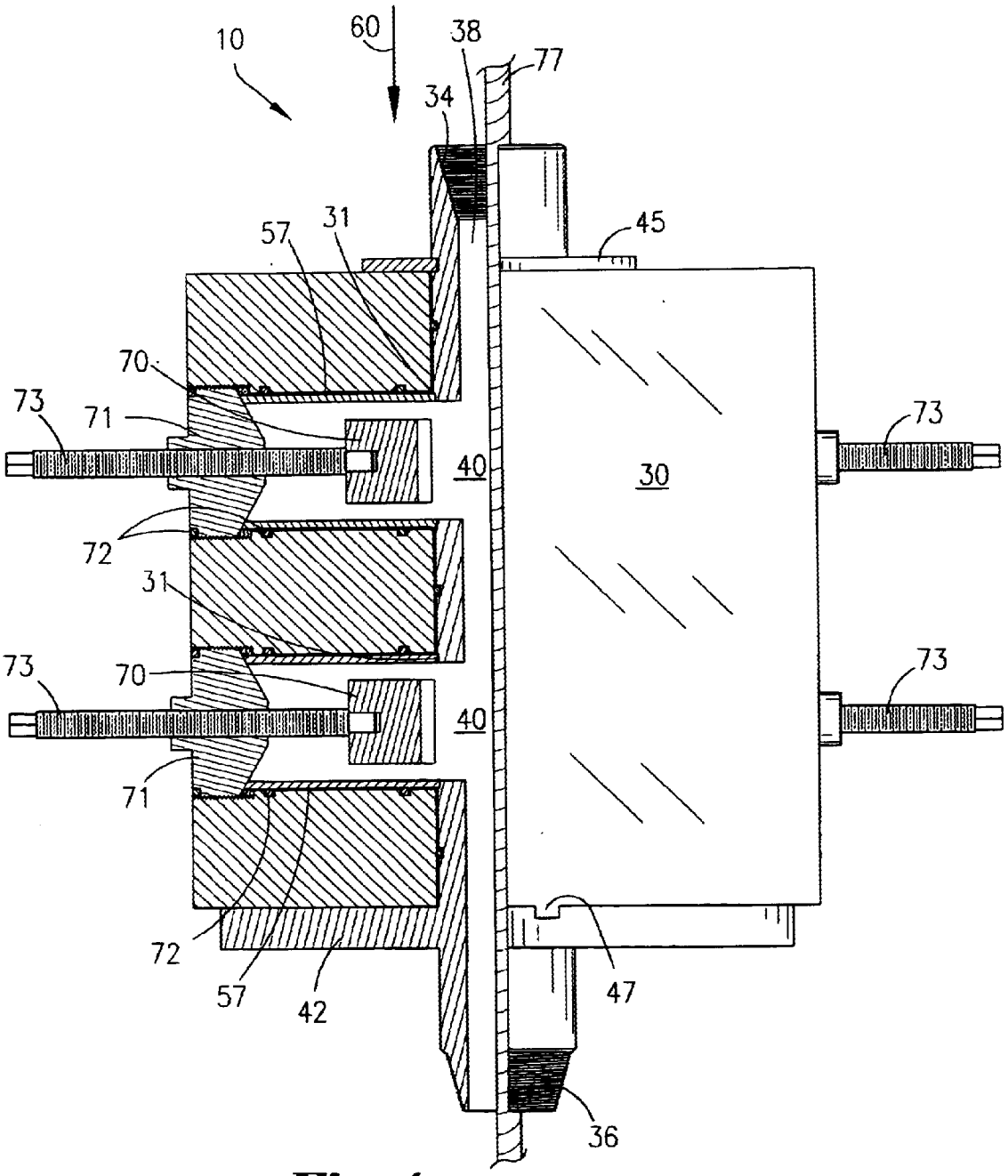
FIG. 4 is a cross-section view of a double core assembly utilized in the preferred embodiment of the present invention.
Figure 6:
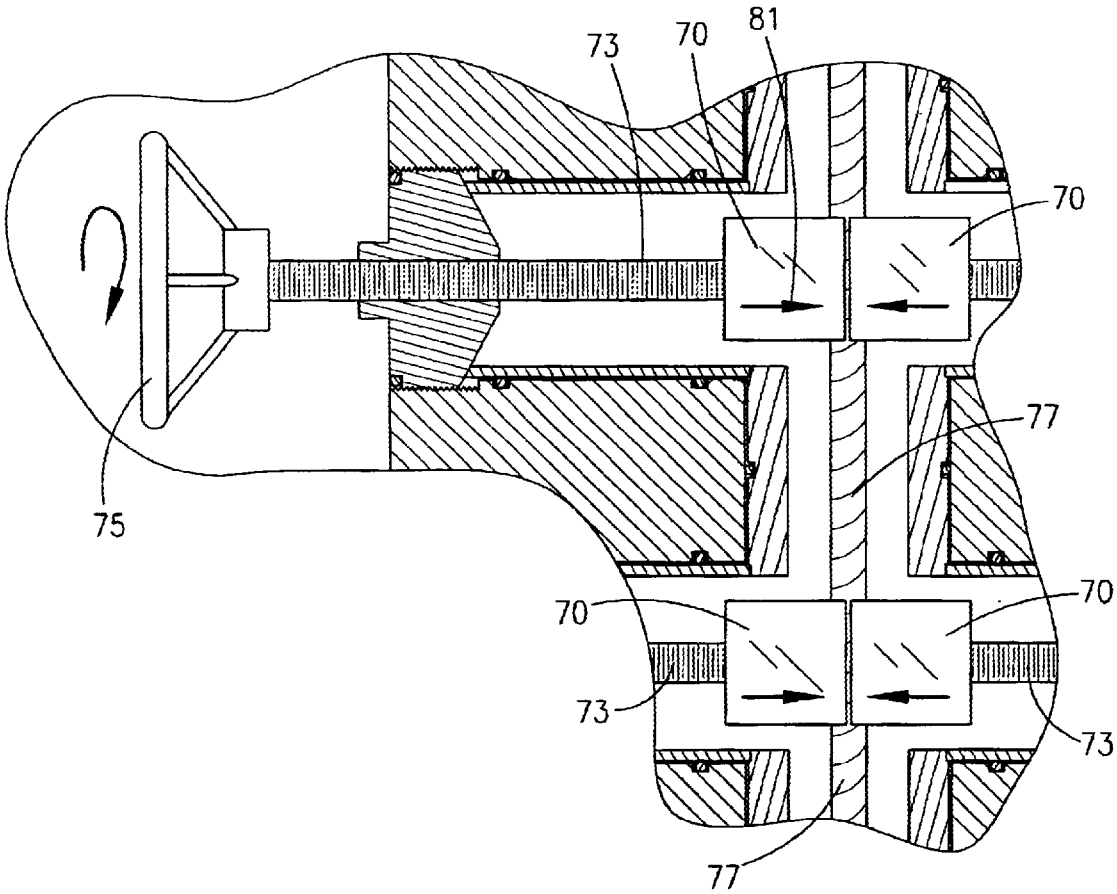
FIG. 6 is an isolated view of the pistons in a double core assembly engaging a wireline.
Figure 7:
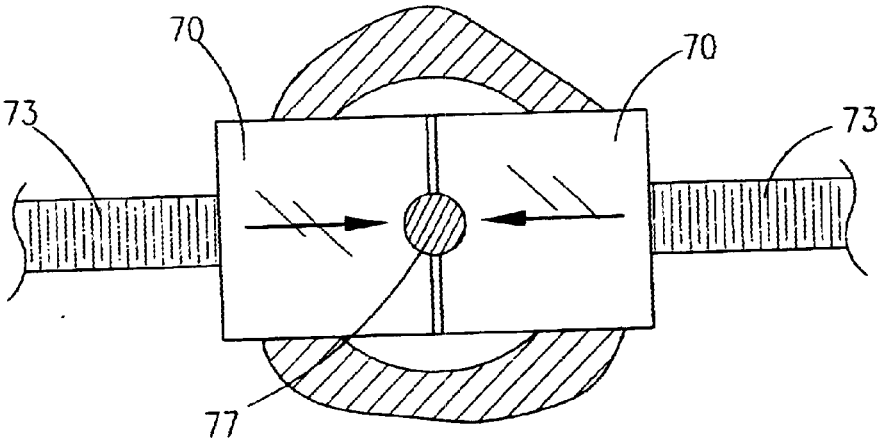
FIG. 7 is a top view of the view of the pistons in an assembly engaging the wireline.
Figure 9:
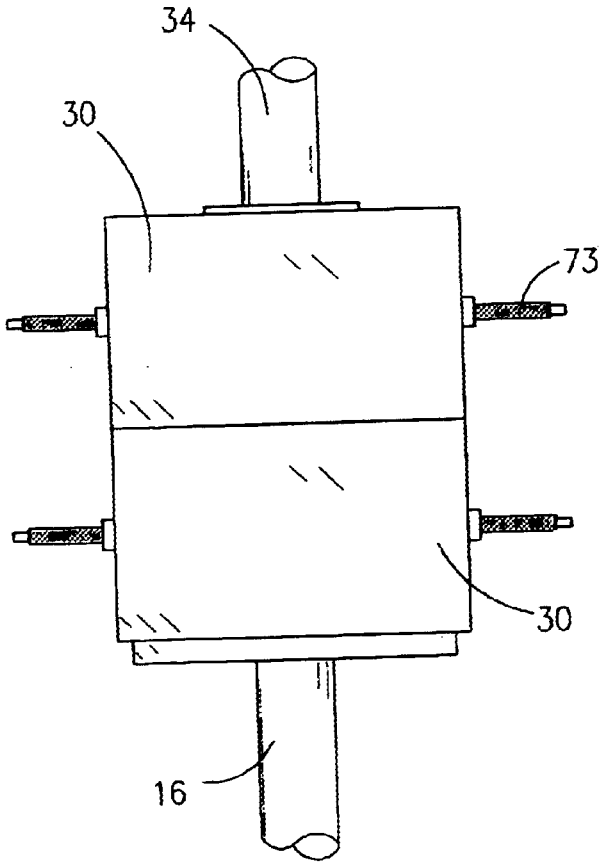
FIG. 9 an overall view of a pair of single assemblies of the present invention positioned below a regular swivel or torque swivel for use during wireline work in the drill string above the rig floor.
Figure 8:
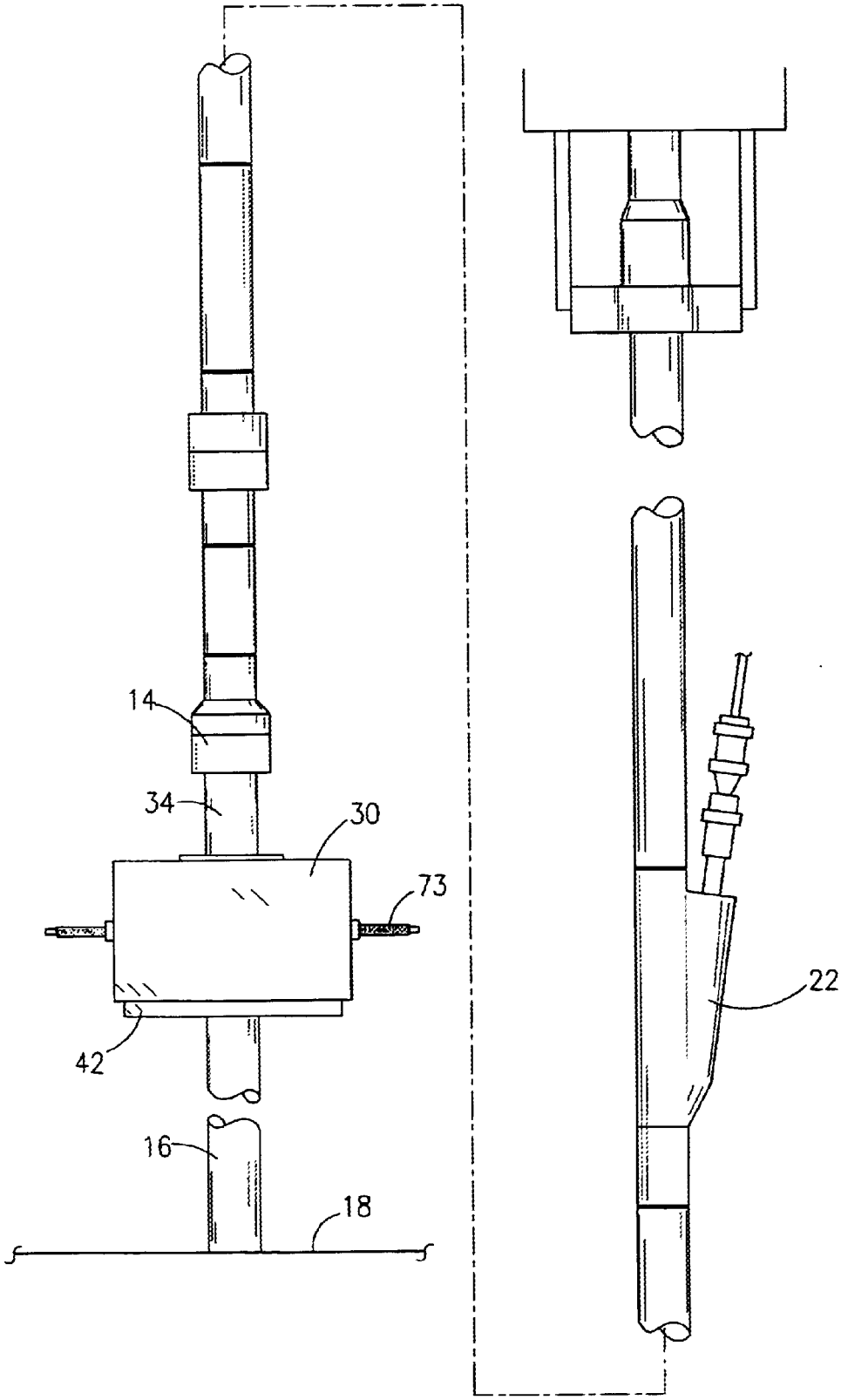
FIG. 8 an overall view of a single assembly of the present invention positioned below a torque swivel or regular swivel for use during wireline work in the drill string above the rig floor.
Figure 10:
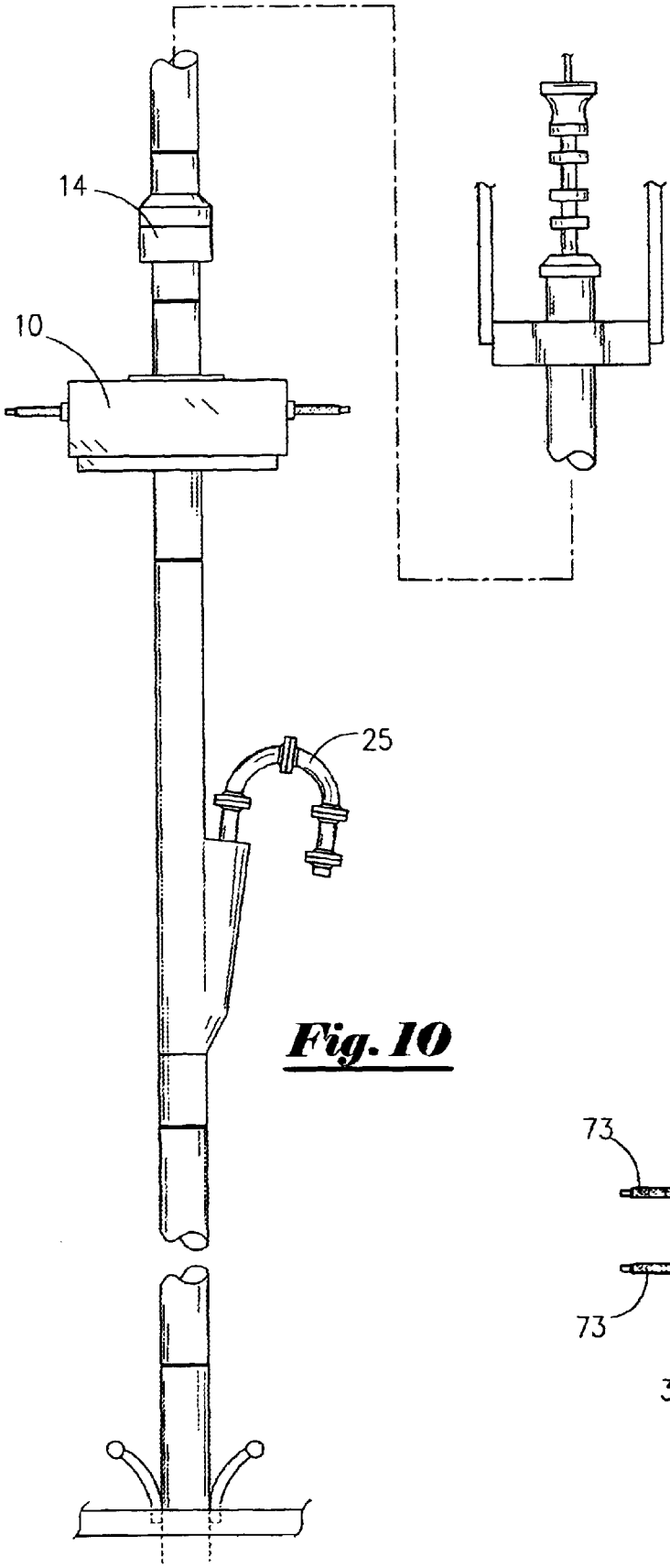
FIG. 10 illustrates a single assembly below the regular swivel or locking swivel and above the medium side entry or fly out sub of the present invention above the rig floor.

FIGS. 1–11 illustrate the preferred embodiment of the apparatus and system of the present invention as would be utilized in a drill string. The apparatus 10, which would be called a high torque floatable seal body assembly, or simply the assembly 10, would be positioned as seen for example in FIG. 8, would be positioned on a drill string 12 below a locking or regular swivel 14, and a length of drill pipe 16. In effect, the high torque floatable seal body assembly 10 would be an assembly for use as a blowout preventor within the drill string above the rig floor 18, as seen in FIG. 8, which heretofore had only been placed above a packoff 20 of a side entry device 22. In operation, the assembly 10 could be utilized as a single assembly 10 as seen in FIG. 1, a pair of assemblies 10, positioned atop one another, as seen in FIG. 10, or as a composite double assembly as seen in FIG. 4. In each configuration, the operation of the assembly would be to carry out the same function.

Turning now to the single assembly apparatus, reference is made to FIG. 1 where is seen in cross section view the outer core assembly 30 which includes an inner core portion 32 having a threaded portion 34 on its upper end and a male threaded portion 36 on its lower end. The upper threaded end 34 would connect to the lower end of the swivel, for example, 14, as seen in FIG. 8, and the lower end 36 of the inner core assembly 32 would attach to the section of drill pipe 16, as illustrated in FIG. 8. The inner core 32 includes a continuous bore 38 therethrough, as seen in FIG. 1, for allowing the flow of fluids or other item such as coiled tubing and a wireline 77 therethrough as it is inner-connected between the swivel and the to length of drill pipe. The core 32 would also include a transverse bore 40 extending across its entire width, as seen in FIG. 1, which would intersect the vertical bore 38 therethrough. Transverse bore 40 would house pistons therein as would be described further.

The inner core portion 32 further provides a substantial shoulder portion 42, as seen in FIG. 1 for allowing the assembly outer core assembly 30 to rest thereupon, as will be discussed further, during use of the apparatus. Further, there is noted an annular indentation 44 around the wall of inner core 32 which would house a ring 45 which would maintain the outer core assembly 30 to rest on shoulder 42, again as will be discussed further.

As further seen in FIG. 1, expanded shoulder 42 would hold the outer assembly body 30 in line by key slot 47 that will maintain the outer assembly 30 and allow rotation with the inner core assembly 32. Key slot 47 will allow slight movement up and down as the weight of the drill string creates a certain amount of stretch. The key slot 47 is large enough to keep the inner core assembly 32 and the body 30 (in FIG. 1) rotating together and keeping the entire assembly 10 in line. In that way, the locking sleeve 45 slides on the upper portion of the inner core assembly 32 and would be locked as seen in FIG. 1. The sleeve 45 will keep the body 30 in line with core 32 so that under heavy loads, although inner core 32 may have stretch, the locking sleeve 45 will allow core 32 to stay in line. When seals are needed in going into seal against internal applications, the seal will properly seal without a bending motion or torque on body 30.

Turning to FIGS. 2 and 3, there is illustrated the block assembly 30 which would be described as a substantially cubical shape or a circular shaped block having a first vertical bore 52, the bore 52 having an interior diameter substantially equal to the exterior diameter of inner core assembly 32. There would further be provided transverse bores 54, 56, extending through each end 55 of the body 30 which would be in communication with the bore 52 through the body 30 which would house the inner core assembly 32. One must need to review both FIGS. 1 and 2 and in doing so, these two bodies 30 and 32 work in combination. That is, the block 30 would be slidably engaged upon the upper end of core assembly 32 in the direction of arrow 60, so that the block assembly 30 would then come to rest upon the upper surface of shoulder 42. When coming to rest thereon, the transverse bores 54, 56 of outer block assembly 30 would be in alignment with transverse bore 40 in the core assembly 32, and would be maintained in line by the key slot assembly 47 as described earlier. When that particular alignment is complete, there would then be provided the upper ring 45 which as seen in FIG. 1, placed into the groove 44 in the wall of inner core 32, so as to maintain the outer block assembly 30 between the shoulder 42 and the ring 45 so that the block 30 would not move up and down during use.

Turning again to FIG. 1, where block 50 is illustrated in phantom view resting on shoulder 42 with the transverse bores 54, 56 of block 30 aligned with bore 40 of central core member 32. In order to assure the proper alignment and to ensure that the pistons which would be operated within the bore 52 and 56 are properly engaged, there would be included a sleeve 57 which would slide within each of bores 54 and 56 and terminate within the notched area 31 in the body wall of core 30. When both sleeves 57 have been pressed into place within bores 54, 56, and engaged into the notches 31, it is therefore assured that the bore 40 and bores 54 and 56 are properly aligned.

Reference is made now to FIG. 1 where there is illustrated block 30 positioned on core element 32 with a piston member 70 having been inserted into each of the bores 54, 56 of block 30. The piston members 70, as illustrated, would threaded through a cap 71 which would be threaded into the bores 54, 56 and sealed therein through O-ring 72. Piston 70 would be secured to the end of a threaded shaft 73 threaded through each cap 71, so that rotation of shaft 73 would move piston 70 in or out of bores 54, 56 as needed. As seen in FIG. 6, if the rotation is done manually, there would be included a handle member 75 positioned at each outer end of shaft 73 in order to manually rotate the shaft 73 and move the pistons inwardly in the direction of arrows 81 as seen in FIG. 6. The sleeves 57 in the bores 54, 56 would also be sealed with O-rings 72, to assure that any fluid which would be involved in the pistons would be sealed therein. The details of the operation of the pistons are not novel in the sense that the pistons used would be the same pistons that are used quite commonly in the industry on such tools as the Bowen blowout preventors.

Figure 5:
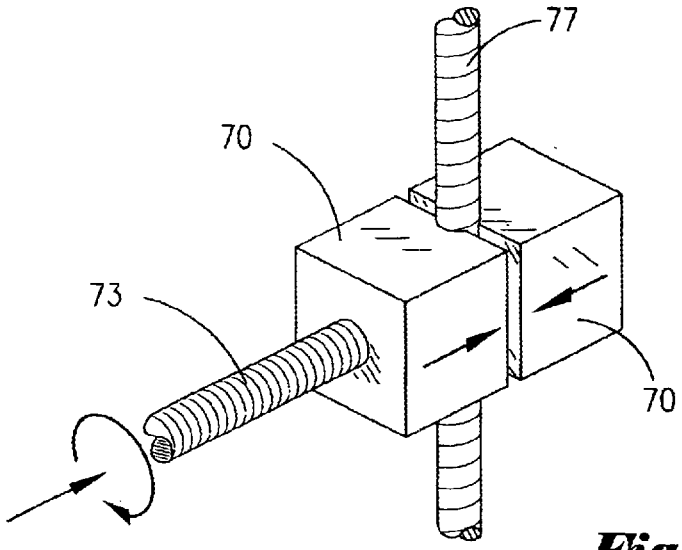
FIG. 5 is an isolated view of the pistons in a single core assembly engaging a wireline.

In the present invention, reference is made to FIGS. 5 and 7, where the pistons 70 are seen in isolated view being moved inwardly to grasp the wireline 77 to prevent fluid flow past that point. The piston member 70 with a shaft 73 which may be operated either hydraulically or manually (FIG. 6) and depending on the rotation of shaft 73, would move the pistons either interiorly or exteriorly. Once they are in place, they would seal against, for example, a wireline 77 which is going throughbores in order to sealingly engage therein. Therefore, should there by any problem with wireline use, as seen in FIG. 8, the positioning of the total assembly 10 below the swivel 14, one would simply engage the pistons to close off the bore 38 and sealingly engage wireline 77 and would prevent any fluid flow through the bore above the assembly 10.

Reference is now made to FIG. 4 where again there is illustrated a core assembly 32 having a bore 38 therethrough, an upper thread engagement 34 and a lower thread engagement 36. Unlike the core assembly as seen in FIG. 1, this particular core assembly would include a pair of lower transverse bores 40 and a pair of upper transverse bores 40 so as to accommodate two sets of pistons 70, rams or blowout preventors thereupon. As with the embodiment as seen in FIG. 1, the assembly would include the key slot 47 which would function in the same manner. Again, there is also included the shoulder member 42 and the upper ring 45. As seen in particular in FIG. 4, the upper block 30 comprises an upper and lower set of transverse bores 54, 56, which has been slidably engaged in the direction of arrow 60 onto the interior core 32 with the dual block assembly 30 in place. Again, there is illustrated a sleeve 57 again of the type that would be slidably engaged into the bores 54 and 56 of the block assemblies and would be latched within notches 31. This would be so for both the upper and the lower sleeves 57 of block 30 so that the dual block 30 would accommodate a pair of pistons therein. This particular embodiment constitutes a more effective mode to be able to maintain a double seal against the wireline. As illustrated in FIG. 6, the double seal is seen with the upper set and lower set of pistons 70 grasping the wireline 77 to effect a more effective seal than a single set of pistons 77 as seen in FIG. 5.

The single block 30, having a double piston set, as seen in FIG. 4, has some undesirable features. In the event the inner core 32 has to take a very heavy load of the drill string attached to its lower end, there is a good chance that the inner core will have some stretch due to the load. Should this occur, the transverse bores 54, 56 will become slightly misaligned with the bores 40 of the inner core, which could affect the ability of the pistons 70 from moving in and out of the inner core 32.

Figure 11:
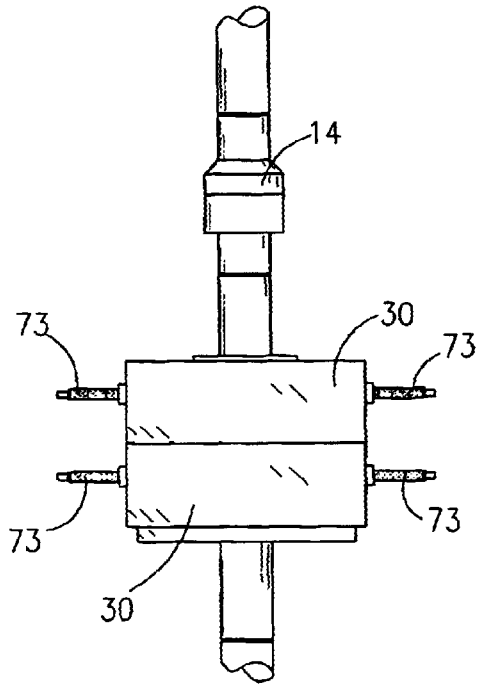
FIG. 11 illustrates a pair of assemblies positioned below the locking swivel or regular swivel but above a fly out side entry sub in the drill string above the rig floor.

Therefore, the preferred embodiment using multiple sealing rams or pistons 70, is to have at least a pair of blocks 30 of the type illustrated in FIG. 1 Therefore, instead of a single block 30, there are a pair of blocks 30 which would each constitute individual upper block 30 and a lower block 30 engaged upon a double bore inner core of the type as seen in FIG. 4. Each of the upper and lower blocks 30 would be slidably engaged onto the core assembly 30, unlike the composite upper and lower blocks as seen in FIG. 4. In effect, the same assembly would be in place as was discussed in FIG. 1, other than it being a pair of pistons as seen in FIG. 3, it would be multiple pairs of pistons, one pair for each block 30. Reference is made to FIGS. 9 and 11 where there is illustrated a first and second block 30 positioned on a double bore inner core 32, thereby creating the double piston effect of FIG. 4; however, again, being two separate and distinct blocks 30.

The desirable effect of having two separate blocks as seen in FIGS. 9 and 11 is that should an enormous weight of drill string pull downward on the apparatus 10, and some stretching occur in the inner core member 32, each separate block 30 will move with the stretch, and any alignment of the transverse bores between block 30 and inner core 32 will not be adversely affected.

It is important to understand that one of the functions of the apparatus 10 is to allow the apparatus to be placed in the drill string. When it is placed in the drill string, this in effect would allow one to seal off the opening in the assembly 10 where the wireline 77 is extending and to undertake any curative or maintenance work above the assembly on the rig floor. However, one of the problems is that once it is sealed off, it is perhaps this assembly may have to carry the entire weight of the drill string which may be hundreds of thousands of pounds or even more. Therefore, in the construction of the assemblies, the assemblies would be quite massive in that the blocks 30 would be made of substantial steel or the like material with bores bored therethrough for the pistons 77. The central core assembly 32 likewise would be a substantial element having sufficiently thick walls so as to withstand the pull of the drill string.

When one is using the multiple assemblies as seen in FIGS. 5, 9 and 11, the reason that the assemblies are kept separate is that when the entire weight of the drill string is pulled on the core 30, there is some stretching of the core, although it be minute from the weight of the string. Therefore, by having separate assemblies, when any stretching occurs, there is no concern that the multiple assemblies would be warped or damaged in any way since they are separate from one other. If the pair of assemblies were kept in one block, then when the stretching of the inner core would take place, it is possible that the block itself would be compromised and the pistons may be pulled upward or downward as the case may be. Because each assembly is allowed to float separately from another one, any stretching would not compromise the integrity of the assembly.

The two upper and lower blocks 30 as seen in FIG. 9 function as a dual set would allow stress and not put a bind on locking sleeve 45 in the inner core 32. Also, each block 30 includes an O-ring 79 also called a polypack, to keep well pressure from leaking out in between the tool on the lower end of the assembly. As seen particularly in FIG. 1, the center core 30 has O-rings 79 which will seal against the upper sections of blocks 30 to maintain pressure internally. Furthermore, blocks 30 will have O-rings 79 to seal against the sleeve 45 when locked in place of the whole assembly to maintain internal well pressure. The ram assemblies that enter the locking sleeve 45 has O-rings on the outside to seal against the locking sleeve inside or i.d. as seal assemblies are hydraulically or manually closed to seal against all applications while maintaining well pressure control.

FIG. 8 illustrates a single assembly 10 as was discussed earlier positioned below the swivel 14 and a drill pipe 16. It is important that the apparatus 10 be positioned below a swivel 14. For the reason that when one is using a side entry device 22 as illustrated in FIG. 8, one may wish to rotate the drill string in order to create downhole torque. Of course, when one would want to rotate the drill string, the upper portion where the side entry device 22 is located would not rotate since the wireline 77 would become wrapped around the entire upper portion of the string. Therefore, the swivel 4 would allow the rotary table to rotate the lower portions of string while not rotating the upper part. When that occurs, the apparatus 10 would likewise rotate with the lower portions of string below the swivel. However, there may be a problem and the apparatus 10 pistons would have to be closed down. There would be no rotation of the string due to the fact that would cause an erosion of the seal between the seals and the wireline.

As was discussed earlier, FIG. 9 illustrates multiple assemblies 10 positioned below the swivel 14. This would be identical to the system as seen in FIG. 8 but for the fact that there are more than one assemblies 10 for the reasons as were discussed earlier.

Turning now to FIG. 10, there is illustrated where the apparatus 10 utilizing the drill string b.o.p.'s seal assembly under the torque swivel 10. Should a problem occur in the pressure line 25 with the wireline being used, if needed to work on manually or hydraulically, one would close the apparatus 10 against the wireline to seal the pressure below it, bleed off the upper pressure above it so work can be done on the pressure line 25 or wireline 77.

Turning now to FIG. 11, FIG. 11 is an identical figure to FIG. 10 but for the fact that there are multiple assemblies 10 utilized above the locking swivel 15 for the reasons as was discussed further. A pair of assemblies 10 are utilized above a side entry device 22 yet below the swivel 14 for particular reasons in working on the upper part of the rig assembly above the swivel 14.

There may be a double or single assembly 10, again positioned below a locking swivel 14 so that curative work may be done on that portion of the rig above the swivel 14 during use. In all cases, again, when this work would go on, the apparatus 10 would be in the closed position, that is sealing off the bore where the wireline is included so as to prevent any fluid flow above the assembly 10 while work is going on above the assembly. In the figure, there shows the safest way into rig up the system. There is flyout side entry sub 22 rigged up with a fluid injection line 25 to the side out of the side entry 22. Tools would be entering down the center bore so if the apparatus needs to be closed to control well pressure below it, and any tools above it need to be worked on or change out rubbers in the packoff, or damage wireline or damage tools, the flyout tool 22 will allow you to still inject heavy fluids and have access to the i.d. of the well and enter to pump in or bleed off pressure from below the seal assembly.

There may be also included chemical cutting or regular logging applications where one can use under high pressure tubing connections and have a grease head on top to control well pressure. This application would allow one to eliminate the Bowen quick connects which are normally used without the elevators and not able to pull on the tubing below when chemical cutting. Also, the elevators of the block would still be latched onto the tubing or drill pipe just below the grease head. When doing many types of applications, one is able to pull while chemical cutting the pipe below with heavy loads and still have availability to rotate the blowout preventors in the present state of the art are unable to rotate or withstand heavy loads during such operations.

In the use of the High Torque and High Capacity Rotatable Center Core and Floatable Sealed Body Assemblies with Universal Ram Applications and Method of the present invention, the assembly of the present invention is required because in the present state of the art there are no seal assemblies which would be engaged in the drill string that would allow one to pick up the entire weight of the drill string, tubing or pipe without damaging the assembly. Furthermore, there are no assemblies on the market today which would enable one to rotate from the top and have the torque completely go through the assembly to rotate the pipe below the assembly. The seal assembly of the present invention will rotate with the pipe. It would be used only as a safety factor when the wireline strands in the grease head and on the pack off assembly have a leak or any of the tools above the assembly or leaking. With the use of the assembly of the present invention, while wireline or coil tubing or small wash pipe could be stopped from entering the bore of the pipe or inside diameter and sealed off by the assembly. One would be able to hold the load of the pipe and seal off on any items that the seals are installed to fit so one could correct the problems above the seal assembly.

The foregoing embodiments are presented by way of example only; the scope of the present invention is to be limited only by the following claims.

What is claimed is:

1. A seal assembly for use in a drill string, comprising:

a. a central core assembly, connected between a swivel on its upper end and the drill string below;

b. a first outer assembly, having a central bore for slidable engagement around a portion of the central core assembly;

c. a pair of opposing transverse bores in the first outer assembly, corresponding to a pair of transverse bores in the central core assembly;

d. means for aligning the bores of the core assembly and the first outer assembly;

e. rams positioned in the transverse bores for sealing off a passageway in the central core assembly.

2. The assembly in claim 1, further comprising a shoulder formed on a wall of the central core assembly upon which the first outer assembly rests.

3. The assembly in claim 1, further comprising a sleeve positioned in each of the transverse bores of the central core assembly and the first outer assembly for defining a single aligned passage for the rams to move during use.

4. The assembly in claim 1, further comprising a pin member to maintain the central care assembly aligned with the first outer assembly.

5. The assembly in claim 1, further comprising a ring positioned above the outer assembly to maintain the first outer assembly in place on the central core assembly.

6. The assembly in claim 1, further comprising a second outer assembly positioned on the first outer assembly, the second outer assembly further comprising a second set of transverse bores which align with a second set of transverse bores in the central core assembly.

7. The assembly in claim 1, wherein the central core assembly is able to withstand the weight of the drill string hanging therefrom with minimal stretching or warping.

8. The assembly in claim 1, wherein the first outer assembly is able to float without any stretching or warping of the central core assembly to eliminate any misalignment of the transverse bores in the first outer assembly with the transverse bores in the central core assembly.

9. A seal assembly for use in a drill string, comprising:

a. a central core assembly, connected between a swivel on its upper end and the drill string below, having a central passageway therethrough;

b. a first outer assembly, having a central bore for slidably engagement around a portion of the central core assembly;

c. a second outer assembly, having a central bore for slidably engaging around a portion of the central core assembly above the first outer assembly;

d. a pair of opposing transverse bores in both the first and second outer assemblies corresponding to a pair of transverse bores in the central core assembly;

e. means for aligning the bores of the central core assembly and the first and second outer assemblies;

f. rams positional in the transverse bores in the first and second outer assemblies for sealing off the central passageway in the central core assembly when moved to the sealing position.

10. The assembly in claim 9, wherein the rams may be operated either manually or hydraulically.

11. The assembly in claim 9, wherein there are O-ring seals between the central core assembly and the first and the second outer assemblies to insure a fluid within the drill string is maintained therein.

12. The assembly in claim 9, wherein a wireline is concentrically placed within the central passageway.

13. The assembly in claim 9, wherein the assembly is able to rotate when the drill string below the swivel is rotated, while the drill string above the swivel remains stationary.

14. The assembly in claim 9, wherein the assembly is positioned above a side entry device but below a swivel to conduct wireline retrieval operations.

15. The assembly in claim 9, wherein the assembly is positioned below a swivel and wherein a wireline side entry device is positioned above the swivel.

16. A method of sealing off flow in a work string above the rig floor, during wireline operations, comprising the following steps:

providing a central core assembly, having a bore therethrough and positioned between a swivel above it and the work string below it, the central core assembly capable of withstanding the weight of the work string connected to said central core assembly therefrom;

engaging an outer assembly around the central core assembly, the outer assembly independent in relation to the central core assembly;

providing a pair of bores through a wall of the outer assembly which align with a pair of bores in the central core assembly which communicate with the bore in the central core assembly;

aligning the bores of the central core assembly with the bores of the outer assembly to allow a common flow passage therethrough;

providing a pair of rams in each of the bores of the outer assembly wherein said rams are capable of moving from an open position to a closed position in order to seal the bore in the central core assembly;

connecting a first end of said central core assembly to a swivel;

connecting a second end of said central core assembly to the work string disposed within a well bore.

* * * * *